US005362300A

United States Patent [19]

Christensen

[11] Patent Number: 5,362,300

[45] Date of Patent: Nov. 8, 1994

[54] SHELL-TYPE CENTRIFUGE ROTOR

[75] Inventor: Dave S. Christensen, Sandy Hook, Conn.

[73] Assignee: E. I. Du Pont de Nemours and Company, Wilmington, Del.

[21] Appl. No.: 85,472

[22] Filed: Jun. 29, 1993

Related U.S. Application Data

[63] Continuation of Ser. No. 66,733, May 27, 1993, abandoned.

[51] Int. Cl.[5] ..... B04B 5/02

[52] U.S. Cl. ..... 494/16; 494/31; 494/60

[58] Field of Search ..... 494/16, 17, 18, 19, 494/20, 21, 31, 60; 210/781, 782; 422/72, 102

[56] References Cited

U.S. PATENT DOCUMENTS

| | | | |
|---|---|---|---|
| 3,366,320 | 7/1965 | Cho . | |
| 3,901,434 | 8/1975 | Wright | 233/27 |
| 4,087,043 | 5/1978 | Anderson | 494/21 |
| 4,132,130 | 1/1979 | Schneider | 74/572 |
| 4,202,487 | 5/1980 | Edwards | 233/1 A |
| 4,360,151 | 11/1982 | Cowell et al. | 233/27 |
| 4,372,483 | 2/1983 | Wright | 494/16 |
| 4,412,830 | 11/1983 | Strain | 494/16 |
| 4,449,965 | 5/1984 | Strain | 494/16 |
| 4,507,047 | 3/1985 | Coons | 415/9 |
| 4,509,896 | 4/1985 | Linsker | 415/9 |
| 4,553,955 | 11/1985 | Lam et al. | 494/16 |
| 4,568,325 | 2/1986 | Cheng et al. | 494/84 |
| 4,820,257 | 4/1989 | Ishimaru | 494/16 |
| 4,832,679 | 5/1989 | Bader | 494/31 |
| 4,921,473 | 5/1990 | Lee | 422/72 |

*Primary Examiner*—Robert W. Jenkins

[57] ABSTRACT

A shell-type centrifuge rotor includes a body member having an upturned lip and a plate having a skirt portion attached to the body. The skirt portion has a groove therein that overlies the lip on the body. The groove defines a relatively high stress region of likely failure of the rotor. A seal is disposed in the groove, the seal extending between the plate and the lip. Failure of the rotor in the vicinity of the groove in the skirt portion at a first operating speed defining an opening through which a portion of the seal may protrude. The protruding portion of the seal generates a force tending to lower the speed of the rotor below the first operating speed. The radially inner surface of the seal ring is inclined toward the axis of rotation. The radially inner boundary surface of the groove is parallel to or inclined radially inwardly toward the axis of rotation.

9 Claims, 5 Drawing Sheets

SHELL-TYPE CENTRIFUGE ROTOR

This is a continuation of application Ser. No. 08/066,733 filed May 27, 1993, now abandoned.

BACKGROUND OF THE INVENTION

1. Field of the Invention

The present invention relates to a shell-type centrifuge rotor.

2. Description of the Prior Art

So-called shell-type rotors are well known in the centrifuge art. In the typical instance a shell-type rotor includes a generally planar body member onto which is attached an upper plate. The upper plate has an array of openings sized to accept sample containers. When received in the openings in the plate the containers project into an open space defined between the upper surface of the body member and the undersurface of the plate.

U.S. Pat. No. 4,449,965 (Strain) is believed a representative example of such a rotor construction. Typically, no seal is provided between the body and the plate. In the rotor disclosed in U.S. Pat. No. 4,832,679 (Bader) the radially outer peripheral region of the body curves inwardly toward the axis of rotation to define a trough. The trough serves to trap liquid which may escape from the containers into the open space.

Owing to its relatively low cost of manufacture a shell-type rotor is a popular rotor choice when a clinician is presented with the task of spinning a relatively small sized sample (on the order of two milliliters). Moreover, a shell-type rotor may be used for protocols that extend into the superspeed regime, with rotational speeds on the order of fifteen thousand rpm being typical.

As with any rotor, there is a possibility that a shell-type rotor may fail in operation. Typical causes of failure include fracture due to fatigue or due to excessive forces generated by an overspeed condition. Even though relatively light in weight, because of the rotational speed at which it may be operated, failure of a shell-type rotor may cause significant damage to the centrifuge instrument in which it is used.

It is, therefore, believed advantageous to provide a braking system for a shell-type rotor that minimizes the risk of damage to the instrument in the event of rotor failure. In addition, it is believed advantageous to provide a seal arrangement for sealing the space between the body and upper plate of a shell-type rotor.

SUMMARY OF THE INVENTION

The present invention is directed to a shell-type centrifuge rotor for use in a centrifuge instrument having a bowl. The rotor comprises a body member having an upturned lip, a plate attached to the body, and a seal ring extending between the plate and the lip. The plate has a skirt portion thereon. The skirt portion overlies the lip on the body. The skirt has an underside with a groove formed therein. The seal ring is disposed in the groove. The seal ring has a radially inner surface and a radially outer surface thereon. The groove includes a radially inner boundary surface.

In accordance with a first aspect of the invention, the groove defines a relatively high stress region of likely failure of the rotor. Failure of the rotor in the vicinity of the groove at a first operating speed creates an opening in the skirt through which a portion of the seal may protrude. The protruding portion of the seal generates a force tending to lower the speed of the rotor below the first operating speed. The force may be in the nature of a windage produced as the protruding portion of the seal rotates with the rotor. Alternately, if the seal protrudes sufficiently to contact against the bowl of a centrifuge instrument, a frictional force is generated by contact between the seal and the bowl. In either case the rotor speed is reduced.

In accordance with other aspects of the invention, the radially inner surface of the seal ring is inclined radially inwardly toward the axis of rotation of the rotor. In addition, the radially inner boundary surface of the groove is parallel to or inclined radially inwardly toward the axis of rotation.

BRIEF DESCRIPTION OF THE DRAWINGS

The invention will be more fully understood from the following detailed description, taken in connection with the accompanying drawings, in which:

FIG. 2 is an enlargement of a portion of FIG. 1, illustrating a seal ring extending between the lip of the rotor body and the skirt portion of the upper plate of the shell-type centrifuge rotor, while

DETAILED DESCRIPTION OF THE INVENTION

Figure 1:
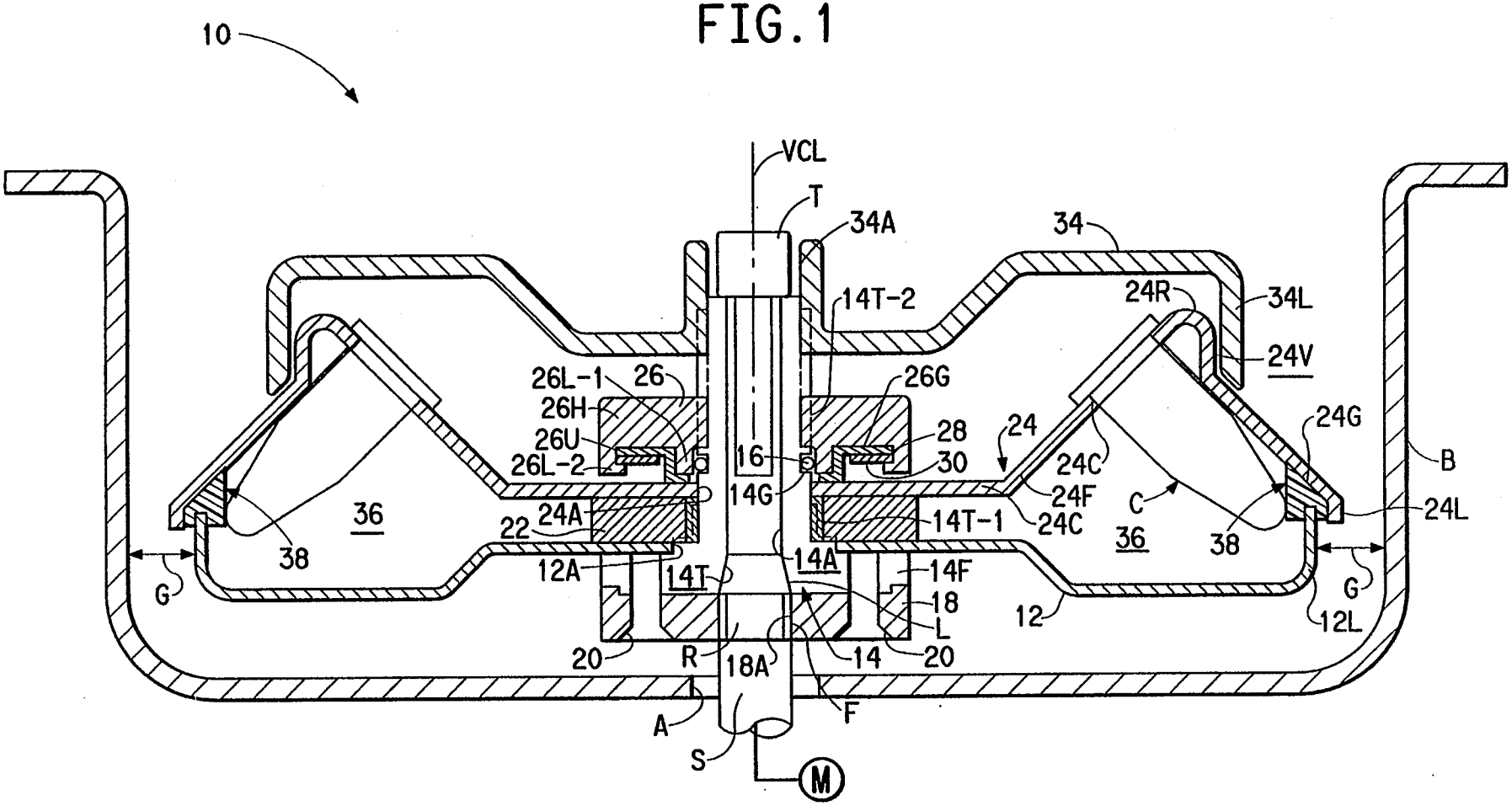
FIG. 1 is a side elevational view, substantially entirely in section, of a shell-type centrifuge rotor in accordance with the present invention.

Throughout the following detailed description similar reference characters refer to similar elements in all Figures of the drawings.

Figure 2:
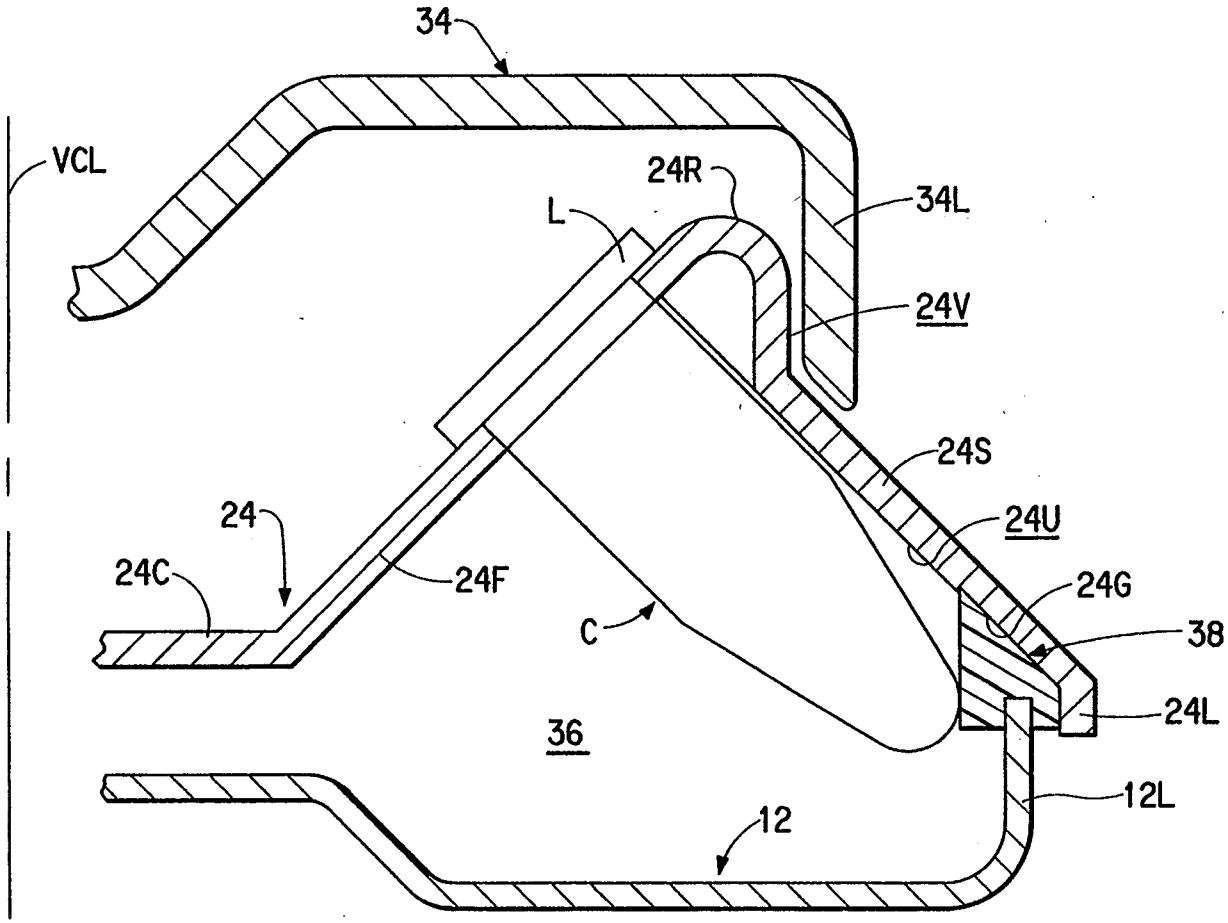

FIGS. 1 and 2 shows a shell-type centrifuge rotor generally indicated by the reference character 10 in accordance with the present invention. The rotor 10 is shown as mounted to the upper end of a drive shaft S (FIG. 1) that projects centrally and axially through an opening A in the bowl B of a centrifuge instrument. The shaft S is connected to a motive source M. The shaft S has an axis of rotation VCL extending vertically and axially therethrough. The rotor 10 rotates about the axis of rotation VCL.

The rotor 10 includes a body member 12 having a central opening 12A therein. The radially outer extent of the body 12 is upturned to define a lip 12L. The body 12 is fabricated from any suitable material, such as aluminum, as by stamping. A drive adapter 14 (FIG. 1) extends centrally and axially through the opening 12A in the body 12. The drive adapter 14, which is fabricated from a metal, is not sectioned in FIG. 1 for clarity of illustration. The drive adapter 14 itself has a central axial opening 14A extending therethrough, with the lower portion of the opening 14A being provided in the form of a frustoconical locking taper 14T. The taper 14T is configured to receive a similarly configured locking surface L formed on the shaft S. The drive adapter 14 has a radially enlarged flange portion 14F thereon. The upper surface of the flange 14F defines a shelf which accepts and supports the central portion of the body 12. Both the middle and upper portions of the outer surface of the adapter 14 are threaded, as at 14T-1, 14T-2, respectively. A groove 14G extends about the adapter 14 at a location thereon axially between the thread portions 14T-1, 14T-2. An O-ring 16 is provided within the groove 14G for a purpose to be described.

In some instances the shaft S may have a region R thereon which is configured to exhibit one or more flat or other noncircular surface(s) F thereon. To accommodate such a region R, a drive collar 18 may be secured to the undersurface of the drive adapter 14, as by bolts 20. The drive collar 18 has an opening 18A therein. The shape of the opening 18A in the drive collar 18 is configured to match the shape of the surfaces F disposed on the region R of the shaft S.

A spacer nut 22 is threaded to the adapter 14 on the first threaded portion 14T-1. The spacer nut 22 serves to attach the the body member 12 to the adapter 14.

An upper plate 24 is received on the adapter 14. The plate 24 has a generally planar central portion 24C having an opening 24A therein. The opening 24A in the plate 24 pilots (or, is closely received on) the drive adapter 14 so that the plate 24 does not shift during operation. The plate 24 is bent to define a generally frustoconical portion 24F. The frustoconical portion 24F is interrupted by an array of openings, or cavities, 24C. Each cavity 24C is sized to receive a sample container C. Each container C has a flange L thereon. The radially outer extent of the frustoconical portion 24F is rounded, as at 24R, and defines a generally vertical surface 24V and a frustoconical skirt portion 24S. The frustoconical skirt portion 24S vertically overlies the lip 12L of the body 12. The skirt portion 24S ends in a lip 24L.

The undersurface 24U of the plate 24 in the vicinity of the skirt portion 24S has a groove 24G formed therein. The groove 24G is presented to the lip 12L of the body 12. For purposes that will become more clear herein the groove 24G defines a relatively high stress region of likely failure of the rotor 10.

Figure 2A:
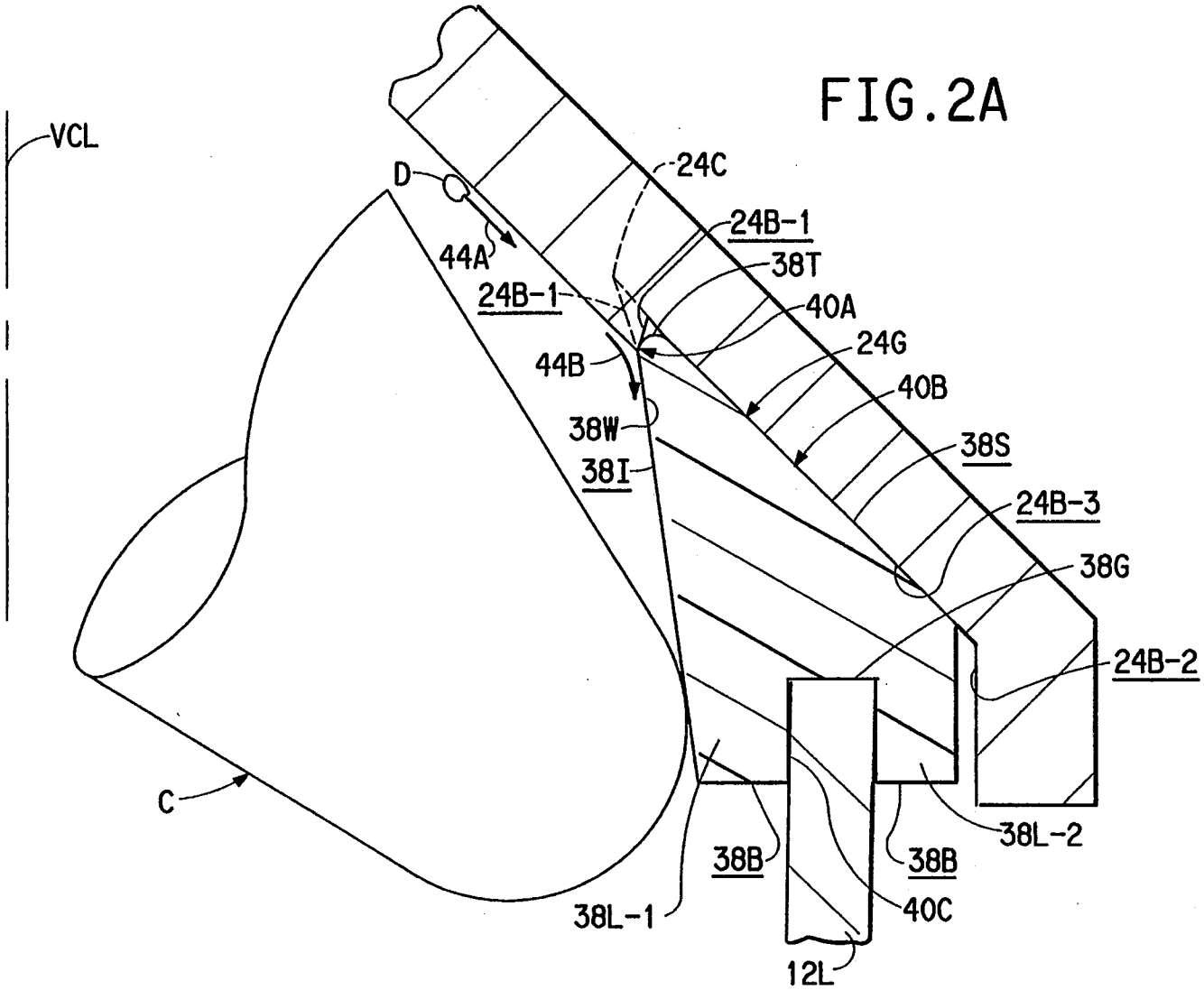
FIG. 2A is a still further enlargement of the circled portion of FIG. 2 more fully illustrating the seal ring and the structure of the upper plate in which the ring is received.

As is best viewed in FIG. 2A, the groove 24G is defined by a radially inner boundary surface 24B-1, a radially outer boundary surface 24B-2 (in the instance illustrated, formed by the radially inner surface of the lip 24L), and a base surface 24B-3. In accordance with the present invention the inner boundary surface 24B-1 of the groove 24G must be at least parallel to the axis of rotation VCL. If desired, as shown by the dashed lines in FIG. 2A, the inner boundary surface 24B-1 may be inclined radially inwardly (i.e., toward the axis of rotation) such that the corner 24C defined at the intersection of the inner boundary surface 24B-1 and the base surface 24B-3 lies closer to the axis of rotation than does the edge 24E of the inner boundary surface 24B-1. Stated alternately, the radially inner boundary surface 24B-1 of the groove 24G is arranged so that no portion of the radially inner boundary surface 24B-1 is inclined radially outwardly away from the axis of rotation VCL. The plate 24 is fabricated from a material such as aluminum. If the inner boundary surface 24B-1 is parallel to the axis VCL the plate 24 be conveniently formed by a stamping operation. The groove 24 is machined into the plate 24.

The plate 24 is secured to the adapter 14 by a hold-down knob 26. The knob 26 engages the second threaded portion 14T-2 of the adapter. The undersurface of the head 26H of the knob 26 has a groove 26G therein. The groove 26G is bounded by radially inner and radially outer lips 26L-1, 26L-2, respectively. The radially outer lip 26L-2 is undercut, as at 26U. A washer 28 is trapped within the groove 26G, with the radially inner portion of the washer 28 being trapped between the inner lip 26L-1 and the plate 24. The radially outer portion of the washer 28 is held in the groove 26G by a snap ring 30. The snap ring 30 is received in the undercut portion 26U of the radially outer lip 26L-2 of the knob 26. The presence of the 0-ring 16 in the groove 14G of the drive adapter 14 prevents counter rotation of the knob 26.

A cover 34 is also threadedly received on the second threaded portion 14T-2 of the adapter 14. The cover 34 has a downturned lip 34L that radially overlaps the vertical portion 24V of the plate 24 when the cover 34 is secured to the adapter 14. The cover 34 has a central opening 34A therein. A retaining bolt T extends through the central opening 34A of the cover to secure the adapter 14 to the shaft S.

As is seen from the Figures, an open volume 36 is defined between the plate 24 and the body 12. Sample containers C are received in the cavities 24C in the plate 24 with the flange L on each container C supported on the upper surface of the plate 24, while the major portion of the length of the containers is received within the volume 36. In the event of fracture of one or more of the containers C sample liquid is released into the volume 36.

To prevent the escape of released sample liquid from the volume 36 a seal ring member generally indicated by the reference character 38 is provided between the body 12 and the plate 24. The seal ring 38 is received in the groove 24G on the undersurface 24U of the skirt 24S. The seal ting 38 is in the form of an annular member (FIG. 1) that is generally right-triangular in vertical section (FIGS. 2, 2A). As is best seen in FIG. 2A the seal ring 38 has a radially inner surface 38I, a radially outer sealing surface 38S, and a base surface 38B. The inner surface 38I terminates in a tip 38T. The base surface 38B has a groove 38G formed therein. The groove 38G is defined by inner and outer lips 38L-1, 38L-2, respectively. The upper edge of the lip 12L of the body 12 is snugly received within the groove 38G of the seal 38.

In accordance with the present invention both the radially inner surface 38I and the radially outer sealing surface 38S are inclined with respect to the axis of rotation VCL. When received on the rotor, the inclination of the inner surface 38I is on the order of twenty (20) degrees with respect to the axis VCL. The inclination of the outer surface 38S is steeper, on the order of forty-five (45) degrees, and matches the inclination of the base surface 24B-3 of the groove 24G in the skirt 24S. When the seal ring 38 is received within the groove 24G the tip 38T of the seal ring 38 extends into the groove 24G past the edge 24E (i.e., above the edge 24E as viewed in the FIG. 2A) of the radially inner boundary surface 24B-1. A first sealing interface 40A is defined along the interface between radially inner surface 38I and the inner boundary surface 24B-1. A second sealing interface 40B is defined along the interface between the radially outer sealing surface 38S and the base surface 24B-3 of the groove 24G. With the rotor 10 is in the assembled condition as shown in the Figures, the weight of the plate 24 may cause the seal ring 38 to bend slightly, as indicated by the bend line 38W.

In operation, in the event of breakage of a container C, liquid droplets D released into the space 36 are guided along the undersurface 24U of the skirt 24S, as indicated by the arrow 44A. As seen in FIG. 2A, when the released liquid reaches the vicinity of the groove 24G, the orientation of the inner boundary surface 24B-1 with respect to the axis of rotation VCL, coupled with the centrifugal force effects on the liquid, precludes migration of liquid toward either of the sealing interfaces 40A, 40B. The liquid is instead guided by the inclined radially inner surface 381 of the seal ring 38, as shown by the arrow 44B. Owing to the fact that the radially inner boundary surface 24B-1 of the groove 24G does not incline radially outwardly with respect to the axis of rotation VCL, but is instead at least parallel to the axis VCL (or inclined inwardly with respect thereto), any escaped liquid within the space 36 does not present a challenge to either the first sealing interface 40A or to the second sealing interface 40B. It is noted that centrifugal force effects on the inner lip 38L-1 of the seal 38 insures a fluid tight seal interface 40C between the edge of the lip 38L-1 and the inner surface of the lip 12L of the body 12.

Figure 3:
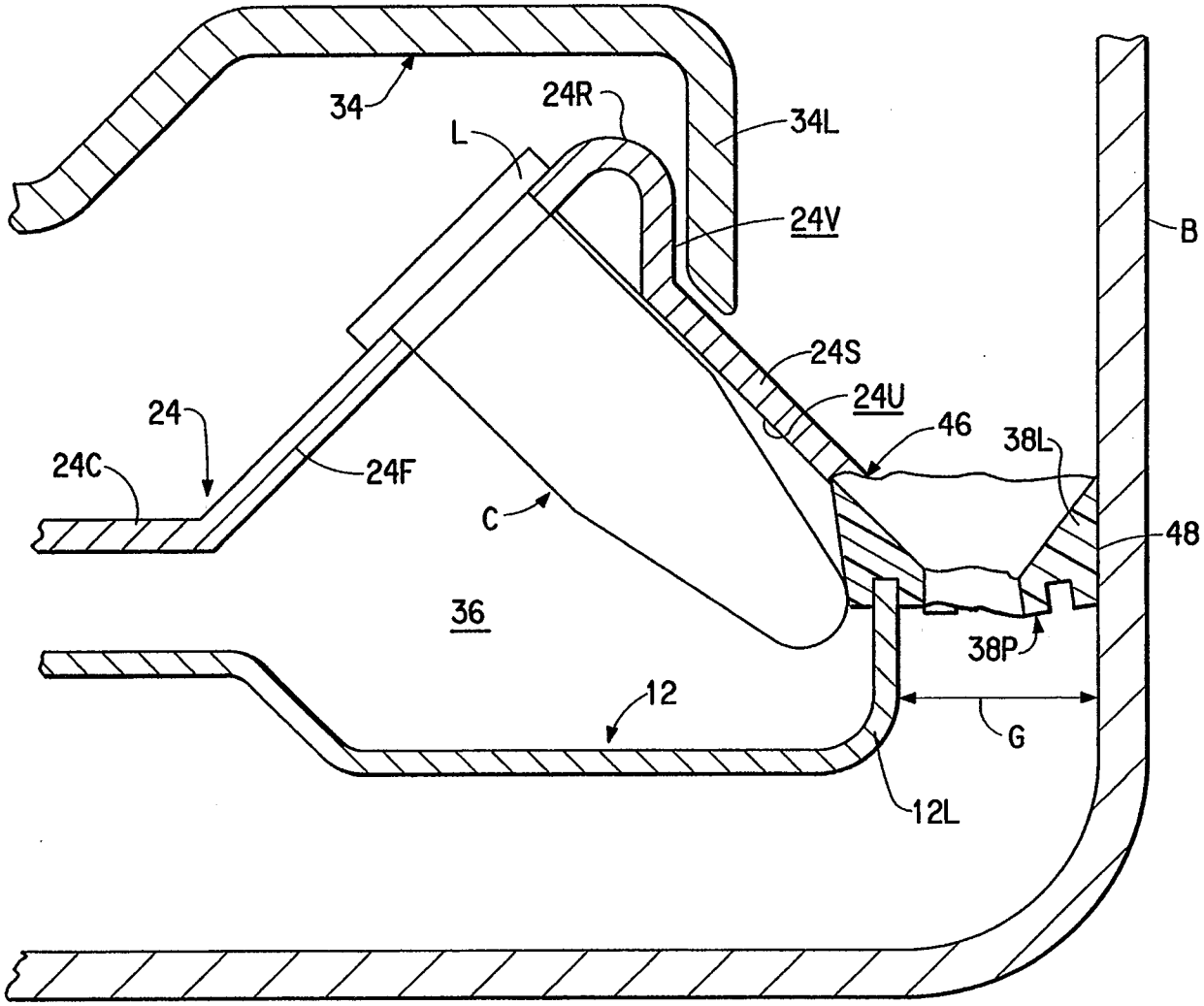
FIG. 3 is a view generally similar to that of FIG. 2, with a portion of the seal ring protruding from an opening in the skirt portion of the upper plate.
Figure 4:
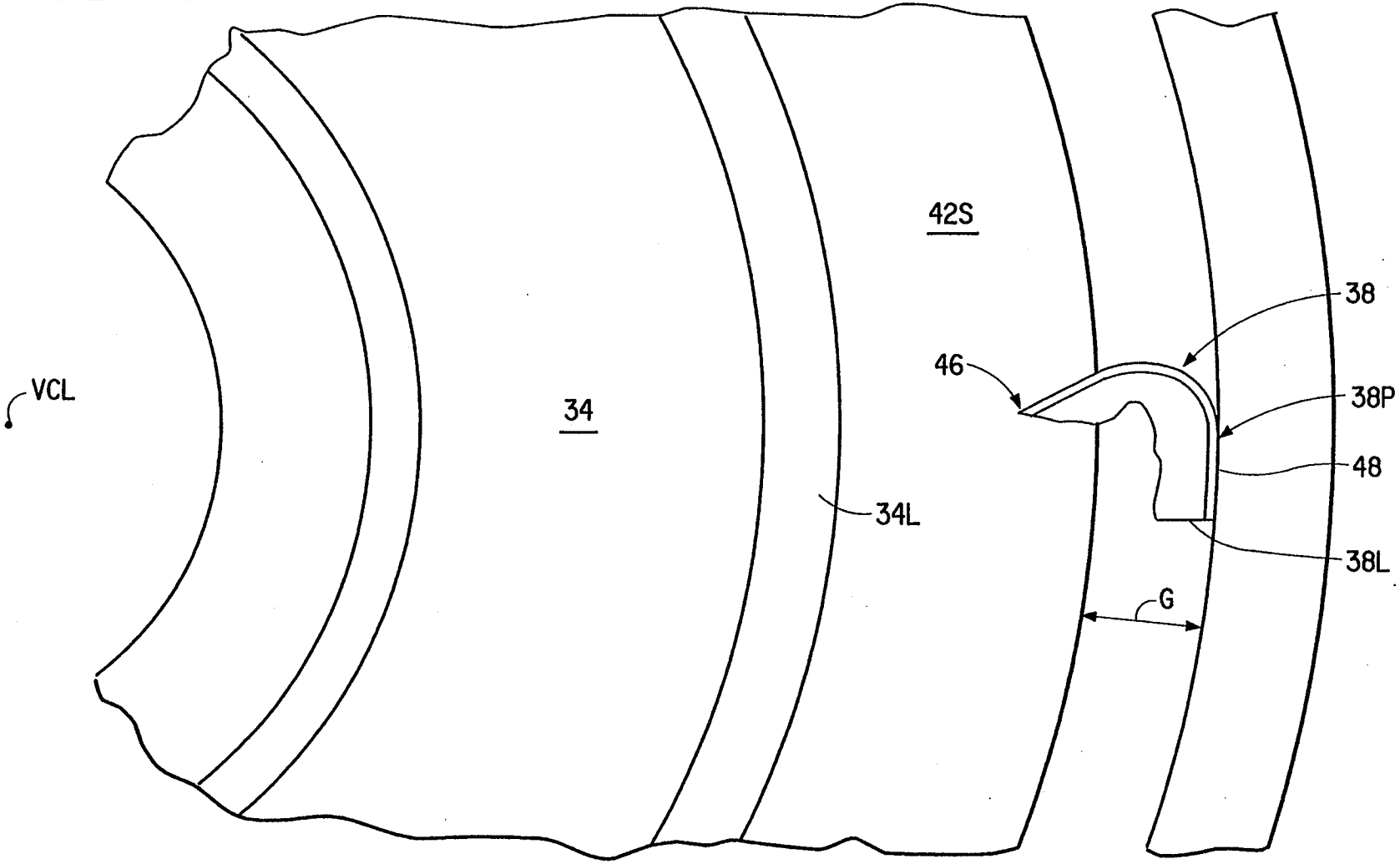
FIG. 4 is a plan view of FIG. 3, illustrating the contact between the protruding portion of the seal ring and the bowl of the centrifuge instrument in which the rotor is received.

In addition, if the rotor reaches a predetermined first operating speed $W_1$ the rotor 10 is designed such that a rotor failure will occur in the highly stressed vicinity of the groove 24G in the skirt portion 24S. As may be best understood from FIGS. 3 and 4 failure of the skirt portion 24S defines an opening 46 therein. Centrifugal force may cause the seal ring 38 (which may maintain its integrity) to extrude outwardly through the opening 46. Alternatively, centrifugal force may cause the seal ring 38 to tear, as along a tear line 38L. In either instance a portion 38P of the seal ring 38 protrudes through the opening 46 into the radial gap G (FIGS. 1, 3 and 4) between the rotor 10 and the bowl B of the instrument. At a minimum the protruding portion 38P of the seal ring 38 generates a windage force tending to lower the speed of the rotor below the first operating speed. If the protruding portion 38P of the seal 38 contacts against the bowl B of the instrument (as illustrated at 48 in FIGS. 3 and 4) a frictional force is generated tending to lower the speed of the rotor below the first operating speed.

Those skilled in the art, having the benefit of the teachings of the present invention as hereinbefore set forth, may effect numerous modifications thereto. Such modifications are to be construed as lying within the contemplation of the present invention, as defined by the appended claims.

What is claimed is:

1. A shell-type centrifuge rotor for use in a centrifuge instrument having a bowl, the rotor comprising:

a body member having an upturned lip, a plate attached to the body, the plate having a skirt portion thereon, the skirt portion overlying the lip on the body, the skirt having an underside with a groove formed therein, the groove defining a relatively high stress region of likely failure of the rotor, a seal ring disposed in the groove, the seal ring extending between the plate and the lip, failure of the rotor in the vicinity of the groove in the skirt portion at a first operating speed defining an opening through which a portion of the seal may protrude, the protruding portion of the seal generating a force tending to lower the speed of the rotor below the first operating speed.

2. The rotor of claim I wherein the protruding portion of the seal generates a windage force tending to lower the speed of the rotor below the first operating speed.

3. The rotor of claim 1 wherein the protruding portion of the seal contacts against the bowl of a centrifuge instrument to generate a frictional force tending to lower the speed of the rotor below the first operating speed.

4. The rotor of claim I wherein the rotor is rotatable about an axis of rotation, and wherein the seal ring has a radially inner surface and a radially outer surface thereon, wherein the radially inner surface is inclined radially inwardly toward the axis of rotation.

5. The rotor of claim 1 wherein the rotor is rotatable about an axis of rotation, and wherein the groove has a radially inner boundary surface thereon, wherein the radially inner boundary surface is parallel to the axis of rotation.

6. The rotor of claim I wherein the rotor is rotatable about an axis of rotation, and wherein the groove has a radially inner boundary surface thereon, wherein the radially inner boundary surface is inclined radially inwardly toward the axis of rotation.

7. A shell-type centrifuge rotor rotatable about an axis of rotation for use in a centrifuge instrument, the rotor comprising:

a body member having an upturned lip, a plate attached to the body, the plate having a skirt portion thereon, the skirt portion overlying the lip on the body, the skirt having an underside with a groove formed therein, the groove having a radially inner boundary surface with an edge thereon, no portion of the radially inner boundary surface being inclined away from the axis of rotation, a seal ring disposed in the groove, the seal ring extending between the plate and the lip, the seal ring having a radially inner surface and a radially outer surface thereon, the radially inner surface of the seal ring terminating in a tip, the tip extending into the groove past the edge of the radially inner boundary surface of the groove, the radially inner surface of the seal ring being inclined radially inwardly toward the axis of rotation.

8. The rotor of claim 7 wherein the radially inner boundary surface of the groove is parallel to the axis of rotation.

9. The rotor of claim 7 wherein the radially inner boundary surface of the groove is inclined radially inwardly toward the axis of rotation.

* * * * *